United States Patent [19]

Lax et al.

[11] Patent Number: 4,883,111

[45] Date of Patent: Nov. 28, 1989

[54] INGOT MOULD FOR CONTINUOUS CASTING

[75] Inventors: Hermann Lax, Düsseldorf; Waldemar Radtke, Oberhausen; Karl-Heinz Wyrwas, Moers, all of Fed. Rep. of Germany

[73] Assignee: Thyssen Stahl Aktiengesellschaft, Duisburg, Fed. Rep. of Germany

[21] Appl. No.: 258,402

[22] Filed: Oct. 17, 1988

[30] Foreign Application Priority Data

Oct. 23, 1987 [DE] Fed. Rep. of Germany ..... 3735883

[51] Int. Cl.[4] ..... B22D 11/04

[52] U.S. Cl. ..... 164/436; 164/418

[58] Field of Search ..... 164/418, 154, 435, 436

[56] References Cited

U.S. PATENT DOCUMENTS

| | | | |
|---|---|---|---|
| 4,124,059 | 11/1978 | Roggo | 164/436 |
| 4,147,202 | 4/1979 | Gay | 164/436 |
| 4,487,249 | 12/1984 | Wrhen | 164/436 X |
| 4,506,724 | 3/1985 | Vial | 164/436 |

FOREIGN PATENT DOCUMENTS

| | | | |
|---|---|---|---|
| 0107564 | 5/1984 | European Pat. Off. | 164/436 |
| 2620751 | 11/1977 | Fed. Rep. of Germany . | |
| 2742742 | 3/1978 | Fed. Rep. of Germany . | |
| 2436636 | 4/1980 | France | 164/418 |
| 2436637 | 4/1980 | France | 164/418 |
| 52-25372 | 7/1977 | Japan | 164/436 |
| 57-14443 | 1/1982 | Japan | 164/436 |
| 59-29344 | 7/1984 | Japan | 164/436 |

*Primary Examiner*—Richard K. Seidel
*Assistant Examiner*—J. Reed Batten, Jr.
*Attorney, Agent, or Firm*—Sprung Horn Kramer & Woods

[57] ABSTRACT

The mould includes wide side plates 4, 5 and adjustable narrow side plates 2, 3 which can be clamped by the wide side plates 4, 5. Adjusting cylinders 11 operable by a hydraulic pressure medium are used to adjust and tension the wide side plate 5. To prevent the tensioning from becoming accidentally loosened if the pressure medium fails, the wide side plate 5 is additionally supported, more particularly on clamping elements 12 which can be clamped to the piston rods 13 of the adjusting cylinders 11. A control device 21 activates the clamping elements 12 when a limit pressure is reached at the adjusting cylinders 11.

9 Claims, 2 Drawing Sheets

A
E
F
B
C
D
G
1
5
10
11
12
12a
12b
13
14
15
16
17
18
19
20
21
22
23
24

INGOT MOULD FOR CONTINUOUS CASTING

BACKGROUND OF THE INVENTION

1. Field of the Invention

The invention relates to an ingot mould for continuous casting, comprising: wide side plates, one of which forms a fixed side wall and the other a loose side; adjustable narrow side plates, which can be clamped by the wide side plates; and adjusting cylinders adjustable to a supporting force for the wide side plate forming the loose side wall.

2. Discussion of Prior Art

Various constructions of ingot moulds of the kind specified are known. In such moulds as a rule both narrow side plates can be adjusted by means of adjusting members, more particularly by hydraulic adjusting cylinders; while one of the wide side plates is fixed in a given position in a frame by adjustable supporting elements, for example, adjusting screws, and thereby forms a fixed side wall, the other wide side plate can be adjusted via adjusting members, more particularly hydraulic adjusting cylinders and therefore forms a loose side wall. During the pouring operation, the clamping force of the wide side plate acted upon by the hydraulic adjusting cylinders clamps the narrow side plate positively in the required position between the wide side plates. The advantage of the wide sides being supported on adjusting cylinders is that the supporting force can be adjusted. When the supporting force is exceeded by the strand forming in the mould, the wide side can yield (European Pat. No. 0 107 546 B1; German Pat. No. 32 35 673 A1).

The pressurizing of the wide side plate adjusting cylinders is of decisive importance for the mould to retain its format, since if pressure drops, the clamping is lost, so that the plates yield to the pressure in the mould and move away.

An ingot mould is also known in which the wide side plates are adjusted by means of adjusting screws. To provide the clamping force for the narrow side plate, the wide side plates bear via packs of cup springs against the adjusting screws. Hydraulic tensioning cylinders tension the packs of cup springs. The hydraulic tensioning cylinders are inoperative during the pouring operation. Then the wide side plates bear via prestressed packs of cup springs against the adjusting screws acting as rigid abutments. It is true that that mould avoids the risk run by other moulds that the clamping force is lost if the pressure medium fails, but due to the pack of cup springs, the adjusting screws and the tensioning cylinders, the mould is an expensive construction (German No. OS 27 42 742).

Finally, an ingot mould is known in which hydraulic adjusting cylinders are provided to adjust the narrow side plates. Parallel with the hydraulic adjusting cylinders, guide spars which can be fixed in hydraulically operated clamping bushes ae connected to the narrow sides. Clamping bushes are activated when the adjusting cylinder has moved the associated narrow side plate into the required position (German Pat. No. 26 20 751 A1).

SUMMARY OF THE INVENTION

It is an object of the invention to provide an ingot mould for continuous casting which ensures the reliable resilient supporting of the wide side plate by means of an inexpensive construction.

To this end, an ingot mould of the kind specified in addition to the supporting cylinders the wide side plate forming the loose side wall can be supported on supporting elements which can be locked in dependence on a limit value of the pressure operative at the adjusting cylinders.

The special advantages of the mould according to the invention are that the clamping force of the wide side plate is exerted by the adjusting cylinders, the result being a resilient support, and that if the pressure acting on the adjusting cylinders fails, the clamping force is maintained by the additional supporting elements which then come into operation.

According to one feature of the invention a control device having a pressure monitor which operates the adjusting members of the supporting elements is provided for the blockable supporting elements. Preferably the supporting elements are clamping elements guided on rods. The clamping elements can be operated hydraulically and take the form of tensioning cones. For constructional reasons it is particularly advantageous if the clamping elements act on the piston rods of the adjusting cylinders. Then an adjusting cylinder and a clamping element can in each case form a structural unit.

To allow a change of format, more particularly during continuous casting, according to a further feature of the invention the piston rod of each adjusting cylinder is so coupled via a spacing cylinder having a predefined adjusting travel to the wide side plate that the clamping force of the wide side plate is loosened when the pressure of the spacing is relieved. By the measurement of the adjusting travel the clamping force can be cancelled out to such an extent that the narrow side plates can be adjusted while the sealing effect is still maintained.

DESCRIPTION OF AN EMBODIMENT OF THE INVENTION

An embodiment of the invention will now be described in greater detail with reference to the drawings.

DETAILED DESCRIPTION OF THE EMBODIMENT OF THE INVENTION

Figure 1:
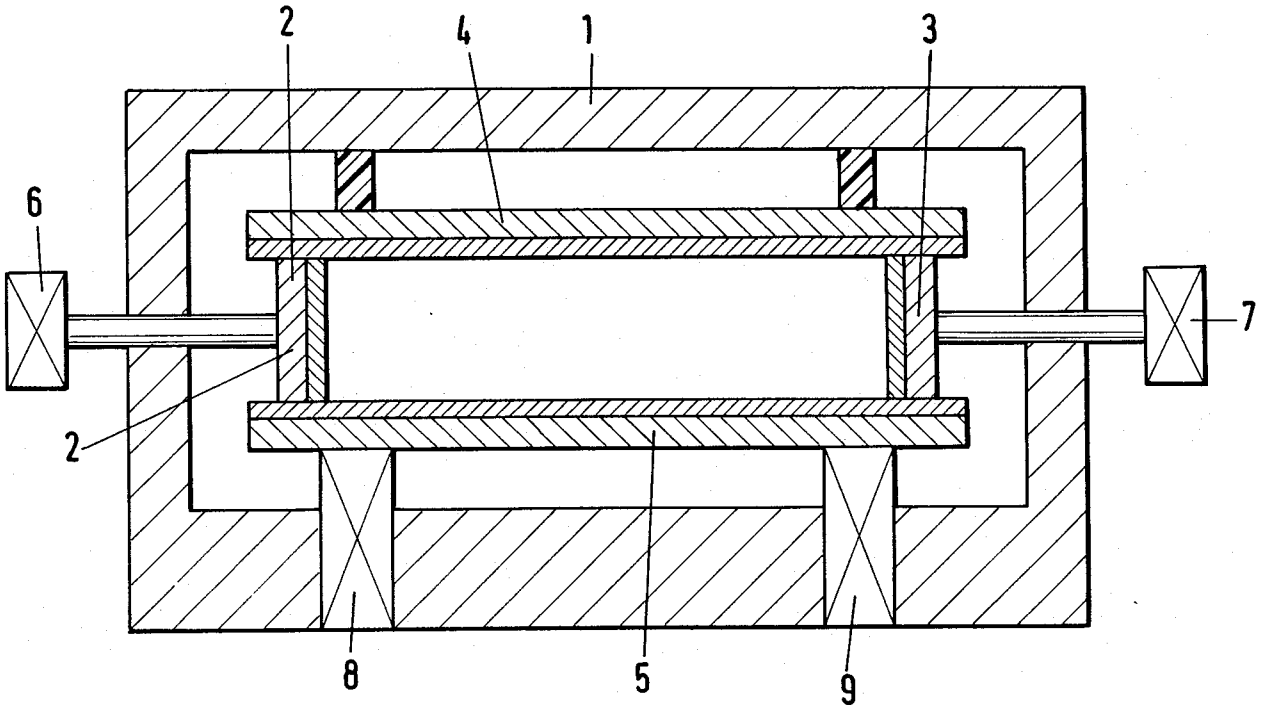
FIG. 1 is a diagrammatic horizontal secton through an ingot mould.
Figure 2:
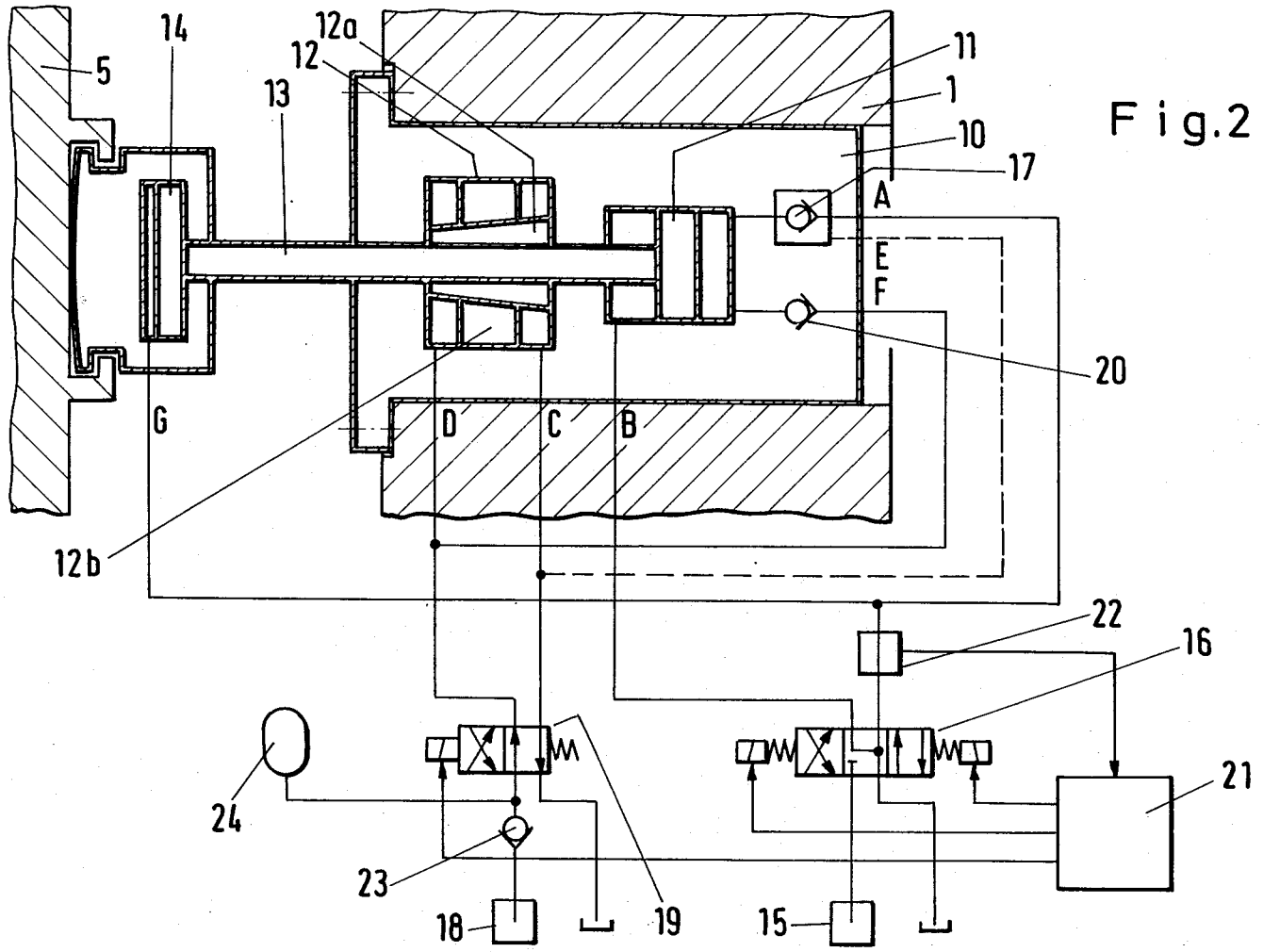
FIG. 2 shows diagrammatically an adjusting cylinder with an additional supporting element connected to a wide side plate.

Narrow side plates 2, 3 and wide side plates 4, 5 are retained in a frame 1. While the wide side plate 4 is adjustably supported directly on the fram 1, the wide side plate 5 is borne against the frame 1 by adjusting cylinders 8, 9. The narrow side plates 2, 3 can be adjusted to the required width of the strand to be cast by adjusting members 6, 7 guided in and abutting the frame 1. During the casting operation the narrow side plates 2, 3 are retained by the wide side plates 4, 5 by clamping. While the wide side plate 4 is fixed in the frame 1 and therefore forms a fixed side wall, the wide side plate 5 can be adjusted by means of the adjusting cylinders 8, 9 retained in the frame 1 and therefore forms a loose side wall. Each of the adjusting cylinders 8, 9 is constructed as shown in FIG. 2.

An adjusting cylinder 11 and a clamping element 12 in the form of a hydraulically operable tensioning cone are disposed as a structural unit in a casing 10 fixed in the frame 1. The clamping element 12 is disposed on the piston rod 13 of the adjusting cylinder 11 and therefore forms a supporting element for the adjustable wide side plate 5. The free end of the piston rod 13 is coupled via a spacing cylinder 14 to the movable wide side plate 5.

The adjusting cylinder 11 can be operated upon by hydraulic pressure on both sides. To clamp the narrow side plates 2, 3, pressure medium is supplied to the adjusting cylinder 11 on its right-hand side, as shown in the drawing, from a first pressure medium source 15, an adjusting value 16 adjusted to the right as shown in the drawing, a line A and a non-return valve 17. From a second pressure medium source 18, the non-return valve 17 is supplied via an adjusting valve 19, adjusted to the right as shown in the drawing, and a control line F, the pressure medium retaining the non-return valve 17 in the opened position. A simple non-return valve 20 provided in another line F, connected to the right-hand side of the adjusting cylinder 11, can prevent the pressure medium from being discharged.

The left-hand side of the adjusting cylinder 11, as viewed in the drawing, can be connected to the pressure medium source 15 by adjusting the adjusting valve 16 to the left-hand position. This connection is made to release or reset the wide side plate 5.

The hydraulically operable clamping element 12 disposed on the piston rod 13 have a conical clamping member **12*a* and disposed thereon a piston 12*b* which can be acted on by pressure medium on both sides. The clamping element 12 is unlocked by supplying the pressure medium via a line C with the adjusting valve 19 in the right-hand position. If the adjusting valve 19 is moved into the left-hand position—i.e., the position shown in the drawing—pressure medium is supplied via the line D, with the consequence that the clamping member 12*a* is clamped on the piston rod 13**, which it fixes.

A control device 21 operates the adjusting valves 16, 19 in dependence on the pressure of the right-hand side of the adjusting cylinder 11, with monitoring by a pressure monitor 22.

The left-hand side of the spacing cylinder 14 is connected via a line G to the line A, so that both cylinders 11, 12 are acted upon by the same pressure. However, a larger pressure surface of the spacing cylinder 14 ensures that the adjusting force of the adjusting cylinder 11 operates via the pressure cushion on the left-hand side of the spacing cylinder 14.

The adjusting cylinder 11 operates in connection with the clamping element 12 and the spacing cylinder 14 in connection with the control device 21 as follows:

When pressure is supplied from the pressure medium source 15 to the lines A and G, the piston of the spacing cylinder 14 is retained in the position shown in the drawing. The operating pressure determined by the pressure medium source 15 is maintained at the adjusted cylinder 11. The adjustable wide side wall 5 is forced by the clamping force corresponding to the pressure against the end faces of the narrow side walls 2, 3.

Since at the same time pressure medium is supplied from the other pressure medium source 18 via the control line E and the non-return valve 23, the non-return valve 17 is retained in the opened position. In contrast, the non-return valve 20 is blocked. This means that the piston of the adjusting cylinder 11 and therefore the wide side plate 5 is resiliently supported against the pressure of the pressure medium source 15.

The pressure is monitored by the pressure monitor 22 and reported to the control unit 21. If the pressure drops below the limit value, the adjusting valve 19 is changed over into the position shown in the drawing. At the same time the adjusting valve 16 is changed over into the central position shown in the drawing. The result of these adjusting operationes is that the clamping element 12 clamps the piston rod 13, the non-return valve 17 is no longer retained in the open position, and pressure medium is supplied via the non-return valve 20 to the right-hand side of the piston of the adjusting cylinder 11. Pressure medium supplied from a pressure medium accumulator 24 ensures that the adjusting cylinder 11 remains in this position during the reaction time of the clamping element 12.

To obtain a wel-defined release of the clamping system, the clamping element 12 is also activated and the lines A and G disconnected from the pressure medium supply and relieved of pressure. The wide side plate 5 can then yield via the travel determined by the piston of the spacing cylinder 14.

To adjust the wide side plate 5, with the clamping element 12 released, the adjusting valve 16 is adjusted to the left, so that pressure medium is supplied via the line B to the left-hand side of the adjusting cylinder 11.

What is claimed is:

1. An ingot mould for continuous casting, comprising: wide side plates (4, 5), one of which (4) forms a fixed side wall and the other (5) a loose side; adjustable narrow side plates (2, 3) clamped by the wide side plates (4, 5); and adjusting cylinders (8, 9, 11) adjustable to a supporting force for the wide side plate (5) forming the loose side wall, characterized in that in addition to supporting cylinders (8, 9, 11) the wide side plate (5) forming the loose side wall is supported on supporting elements (12) which are locked in dependence on a limit value of the pressure operative at the adjusting cylinders (8, 9, 11).

2. An ingot mould according to claim 1, characterized in that a control device (21) having a pressure monitor (22) which operates adjusting members of the supporting elements (12) is provided for the lockable supporting elements (12).

3. An ingot mould according to claim 1, characterized in that the supporting elements (12) are clamping elements guided on rods (13).

4. An ingot mould according to claim 3, characterized in that the rods (13) are the piston rods of the adjusting cylinders (8, 9, 11).

5. An ingot mould according to claim 3, characterized in that the clamping element (12) are operated hydraulically.

6. An ingot mould according to claim 4, characterized in that the clamping elements (12) are clamping cones **(12*a*, 12*b*)**.

7. An ingot mould according to claim 1, characterized in that the adjusting cylinder (11) and the clamping element (12) in each case form a structural unit.

8. An ingot mould according to claim 3, characterized in that the piston rod (13) of each adjusting cylinder (11) is so coupled via a spacing cylinder (14) having a predefined adjusting travel to the wide side plate (5) that the clamping force of the wide side plate (5) is loosened when the pressure of the spacing cylinder (14) is relieved.

9. An ingot mould for continuous casting, comprising: wide side plates (4, 5), one of which (4) forms a fixed side wall and the other (5) a loose side; adjustable narrow side plates (2, 3) clamped by the wide side plates (4, 5); and adjusting cylinders (8, 9, 11) adjustable to a supporting force for the wide side plate (5) forming the loose side wall, characterized in that in addition to supporting cylinders (8, 9, 11) the wide side plate (5) forming the loose side wall is supported on clamping cones (**12*a*, 12*b*) guided on rods (13), which clamping cones (12*a*, 12*b*) are locked in dependence on a limit value of the pressure operative at the adjusting cylinders (8, 9, 11), the rods (13) constituting piston rods of the adjusting cylinders (8, 9, 11), the piston rod (13) of each adjusting cylinder (11) being so coupled via a spacing cylinder (14) having a predefined adjusting travel to the wide side plate (5) that the clamping force of the wide side plate (5) is loosened when the pressure of the spacing cylinder (14**) is relieved.

* * * * *